US005337721A

United States Patent [19]

Kasuya et al.

[11] Patent Number: 5,337,721

[45] Date of Patent: Aug. 16, 1994

[54] FUEL VAPOR PROCESSING APPARATUS

[75] Inventors: Kazusato Kasuya, Kariya; Mitsuo Sugiura, Hekinan, both of Japan

[73] Assignee: Aisan Kogyo Kabushiki Kaisha, Ohbu, Japan

[21] Appl. No.: 99,572

[22] Filed: Jul. 30, 1993

[30] Foreign Application Priority Data

Aug. 25, 1992 [JP] Japan ..... 4-225500

[51] Int. Cl.[5] ..... F02M 33/02

[52] U.S. Cl. ..... 123/519

[58] Field of Search ..... 123/516, 518, 519, 520

[56] References Cited

U.S. PATENT DOCUMENTS

| | | | |
|---|---|---|---|
| 4,308,840 | 1/1982 | Hiramatsu et al. | 123/519 |
| 4,658,796 | 4/1987 | Yoshida et al. | 123/519 |
| 4,951,643 | 8/1990 | Sato et al. | 123/519 |
| 5,143,041 | 9/1992 | Franzke | 123/520 |
| 5,170,765 | 12/1992 | Hoshino et al. | 123/519 |

FOREIGN PATENT DOCUMENTS

| | | | |
|---|---|---|---|
| 61-25568 | 2/1986 | Japan . | |
| 4121450 | 4/1992 | Japan | 123/519 |
| 5033734 | 2/1993 | Japan | 123/519 |
| 5071432 | 3/1993 | Japan | 123/519 |

*Primary Examiner*—E. Rollins Cross
*Assistant Examiner*—Thomas N. Moulis
*Attorney, Agent, or Firm*—Cushman, Darby & Cushman

[57] ABSTRACT

A fuel vapor processing apparatus of an internal combustion engine for a vehicle comprises a main canister, a sub-canister connected to the main canister in series and located closer to the atmosphere than the main canister is, a first one-way valve through which the fluid flows from the main canister to the sub-canister, and a second one-way valve through which the fluid flows in the reverse direction, the first and second one-way valves being provided in parallel between the main canister and the sub-canister.

9 Claims, 7 Drawing Sheets

FUEL VAPOR PROCESSING APPARATUS

BACKGROUND OF THE INVENTION

1. Industrial Field of the Invention

The present invention relates to a fuel vapor processing apparatus of an internal combustion engine in a vehicle.

2. Description of Relative Art

In a conventional fuel vapor processing apparatus, fuel vapor generated in a fuel tank while an engine of a vehicle is stopped is absorbed by absorbents in canisters, and the absorbed fuel vapor is purged while the engine is operated, so that it is supplied to the engine through a suction air passage and burned in the engine. In such a known apparatus, as disclosed in Japanese Utility Model Unexamined Publication No. 61-25568, a main canister and a sub-canister are connected in series, and also, the sub-canister is provided closer to the atmospheric side than the main canister is.

In this apparatus, the sub-canister is located on the atmospheric side of the main canister because such an arrangement suppresses release of the fuel vapor into the atmosphere when the pressure in the fuel tank is increased or decreased and the fuel vapor is not adequately absorbed in the main canister.

More specifically, during driving of the vehicle, the fuel vapor in the canisters is completely purged. Then, when the engine is stopped, the temperature in the fuel tank falls during the night, and the pressure in the fuel tank becomes negative to the atmospheric pressure. In such a case, the air is introduced from the outside (the atmosphere) via the sub-canister and the main canister in order to prevent breakage of the tank.

Next, in the daytime, when the temperature in the fuel tank rises, fuel vapor is generated, and the pressure in the fuel tank becomes positive to the atmospheric pressure. Then, the vapor and the air in the fuel tank is released into the atmosphere via the main canister and the sub-canister in order to prevent breakage of the tank.

In this case, most of the fuel vapor is absorbed in the main canister, and an amount of the fuel vapor which is absorbed in the sub-canister connected to the atmospheric side of the main canister is small, so that it is possible to reduce an amount of the fuel vapor which is released into the atmosphere.

In the conventional technique described above, if the engine is stopped and left as it is for a long time, the fuel vapor in the main canister diffuses and flows into the sub-canister, and consequently, the concentration of the fuel vapor in the sub-canister reaches the same value as that of the fuel vapor in the main canister.

In this state, when the temperature in the fuel tank rises and the fuel vapor in the fuel tank is released into the atmosphere via the main canister and the sub-canister, the fuel vapor having the same concentration as the fuel vapor in the main canister is released from the sub-canister into the atmosphere, thereby polluting the atmospheric air considerably.

In order to solve such a problem, the area of a passage which communicates the main canister with the sub-canister is decreased to reduce diffusion of the fuel vapor into the sub-canister. However, it results in a new problem that the purge flow rate during operation of the engine is decreased, thereby deteriorating the purge performance.

SUMMARY OF THE INVENTION

It is therefore an object of the present invention to provide a fuel vapor processing apparatus for a vehicle by which release of fuel vapor from an air port of a canister into the atmosphere is lessened, and also, a sufficient purge flow rate in the canister during operation of the engine can be surely obtained, so as to solve the above-described problems.

In order to achieve this object, the fuel vapor processing apparatus according to the invention is characterized in that a valve opening pressure of a first valve is set at a high value to suppress release of fuel vapor into the atmosphere from the canister while the vehicle is stopped, and that a valve opening pressure of a second valve is set at a low value to facilitate the purge during traveling of the vehicle.

According to the first aspect of the present invention, a fuel vapor processing apparatus of an internal combustion engine for a vehicle, in which a sub-canister is connected to a main canister in series and located closer to the atmosphere than the main canister is, includes a first one-way valve through which the fluid flows from the main canister to the sub-canister is, and a second one-way valve through which the fluid flows from the sub-canister to the main canister, the first and second one-way valves being provided in parallel between the main canister and the sub-canister.

Also, a valve opening pressure of the first one-way valve may be set higher than that of the second one-way valve.

Further, according to the first aspect, the first one-way valve may include a spring which presses a valve body on a valve seat, and the second one-way valve may include a valve body which is closely fitted on a valve seat by its own weight.

Moreover, according to the first aspect, the second one-way valve may include a valve body of a mushroom-like shape which is made of an elastic material.

According to a second aspect of the present invention, a thermally responsive valve to be opened and closed in accordance with a temperature of the atmosphere in an engine room is provided between the main canister and the sub-canister and designed in such a manner that the opening area of the thermally responsive valve is large at a high temperature and small at a low temperature.

Also, according to the second aspect, the thermally responsive valve may comprise a spherical valve body made of bimetal which is provided on a valve seat, the valve body including a small hole formed in the center and being designed to be curved to project reversely in accordance with the temperature so that the valve body is curved to project downwardly at a low temperature.

According to a third aspect of the invention, an open and close valve which is opened by a suction-pipe negative pressure of the engine to the atmospheric pressure is provided between the main canister and the sub-canister.

According to a fourth aspect of the invention, a cooling water responsive valve which is operated in accordance with the temperature of cooling water for the engine is provided between the main canister and the sub-canister and designed in such a manner that the opening area of the cooling water responsive valve is larger as the temperature of the cooling water is increased.

According to a fifth aspect of the invention, a solenoid valve is provided between the main canister and the sub-canister, and an ignition key switch of the vehicle and a coil of the solenoid valve are connected in such a manner that the solenoid valve is opened and closed cooperatively with the key switch.

According to the first aspect of the present invention, fuel vapor generated in the fuel tank flows into the main canister and is absorbed by an absorbent in it. When the valve opening pressure of the first one-way valve is lower than the fuel tank internal pressure and the first one-way valve is closed, the fuel vapor will not be diffused into the sub-canister.

Consequently, during a stop of the engine, when the pressure in the fuel tank is increased and the fuel vapor in the fuel tank flows through the main canister to the sub-canister, most of the fuel vapor is absorbed in the main canister, and an amount of the fuel vapor absorbed in the sub-canister is small, so that an amount of the fuel vapor which is released into the atmosphere from the sub-canister is small.

Further, when the fuel tank internal pressure is at a predetermined value or less, the first one-way valve is closed, thereby preventing release of the fuel vapor into the atmosphere.

Moreover, when the purge is conducted during driving of the vehicle, the second one-way valve is opened easily under a low pressure so as to enlarge an area of the passage between the main canister and the sub-canister. Thus, the purge flow rate is increased to facilitate the purge.

Furthermore, when the second one-way valve includes the valve body which is closely fitted on the valve seat by its own weight, the valve body is moved vertically owing to vibration of the vehicle during driving of the vehicle, and detached from the valve seat. Thus, the opening area of the second one-way valve is substantially enlarged, and consequently, the purge is conducted more easily. Especially, as the vehicle travels at a higher speed, its vibration is enhanced, and the opening area of the second one-way valve is enlarged effectively.

Still more, when the valve body of the second one-way valve is made of an elastic material and has a mushroom-like shape, the mushroom-like valve body is elastically deformed and opened at the time of the purge so as to enlarge the passage area, thereby conducting the purge efficiently.

According to the second aspect of the invention, when the valve body of the thermally responsive valve is made of bimetal, the valve body is curved to project downwardly at a low temperature and closely attached to the valve seat. Therefore, the passage area of the thermally responsive valve is limited only to a small area of the small hole formed in the center of the valve body made of bimetal, in order to suppress diffusion of the fuel vapor from the main canister to the sub-canister.

Even at the time of the purge during driving of the vehicle, the engine temperature is low at the initial stage of driving, so that the opening area of the thermally responsive valve is small, and that a small amount of the fuel vapor which is absorbed in the canisters is fed to the engine. In consequence, the air-fuel ratio is prevented from unfavorably increasing.

Then, when the engine temperature rises, the valve body made of bimetal is curved to project reversely, and the passage area of the thermally responsive valve is enlarged, thereby increasing the purge amount.

According to the third aspect of the invention, while the engine is stopped, no suction-pipe negative pressure to the atmospheric pressure exists, and the switch valve is closed, so that diffusion of the fuel vapor from the main canister to the sub-canister is suppressed. During driving of the vehicle, the open and close valve is opened due to a suction-pipe negative pressure of the engine to the atmospheric pressure, and an area of the passage between the main canister and the sub-canister is enlarged, thus improving the purge performance.

According to the fourth aspect, while a temperature of the engine cooling water is low, the opening area of the cooling water responsive valve is small and creates a resistance, and consequently, the fuel vapor is not easily released into the atmosphere, and also, a variation in the air-fuel ratio at the time of the purge is decreased. When the temperature of the engine cooling water rises, the opening area of the cooling water responsive valve is enlarged, and the resistance is lessened, thereby facilitating the purge.

According to the fifth aspect, while the ignition key switch is off, i.e., while the engine is stopped, the solenoid valve is closed to prevent release of the fuel vapor into the atmosphere. While the ignition key switch is on, i.e., while the engine is operated, the solenoid valve is opened to increase the purge amount.

DETAILED DESCRIPTION OF THE PREFERRED EMBODIMENTS

Figure 7:
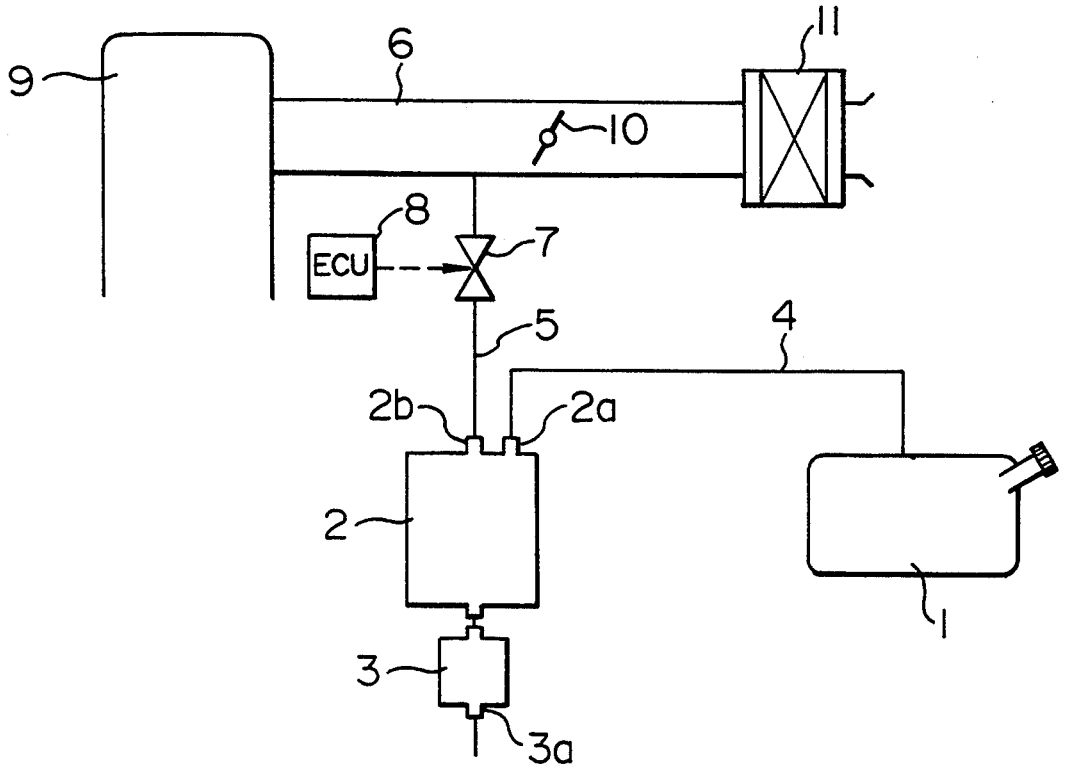
FIG. 7 is a schematic diagram showing a system in which a conventional fuel vapor processing apparatus is employed.

FIG. 7 shows a system with a conventional fuel vapor processing apparatus, comprising a fuel tank 1, a main canister 2, and a sub-canister 3 connected to the main canister 2 in series and located closer to the atmosphere than the main canister is.

A vapor passage 4 communicates an upper air chamber of the fuel tank 1 with a tank port **2*a* of the main canister 2. A purge passage 5 communicates a purge port 2*b* of the main canister 2 with a suction air pipe 6, and a flow rate control valve 7 is inserted in the purge passage 5**.

An opening-area ratio of the flow rate control valve 7 is operated under duty-ratio control by a control unit (ECU) 8 in accordance with engine operating conditions on the basis of signals from various kinds of sensors (not shown), thereby controlling the purge flow rate.

FIG. 7 also shows an engine 9, a throttle valve 10, an air filter 11, and an air port 3*a* of the sub-canister 3.

Figure 8:
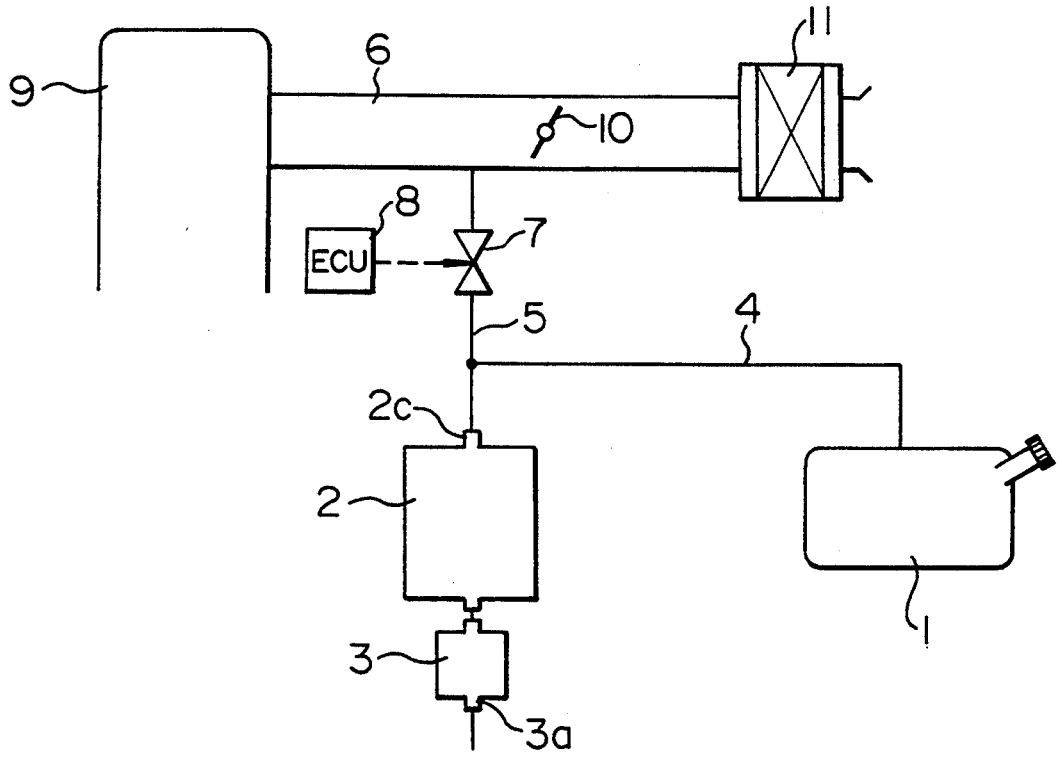
FIG. 8 is a schematic diagram showing another system in which a conventional fuel vapor processing apparatus is employed.

In FIG. 7, the tank port 2*a* and the purge port 2*b* of the main canister 2 are provided independently and connected to one end of the vapor passage 4 and one end of the purge passage 5, respectively. However, as shown in FIG. 8, the vapor passage 4 and the purge passage 5 may be connected to and communicated with one common port 2*c*.

Figure 1:
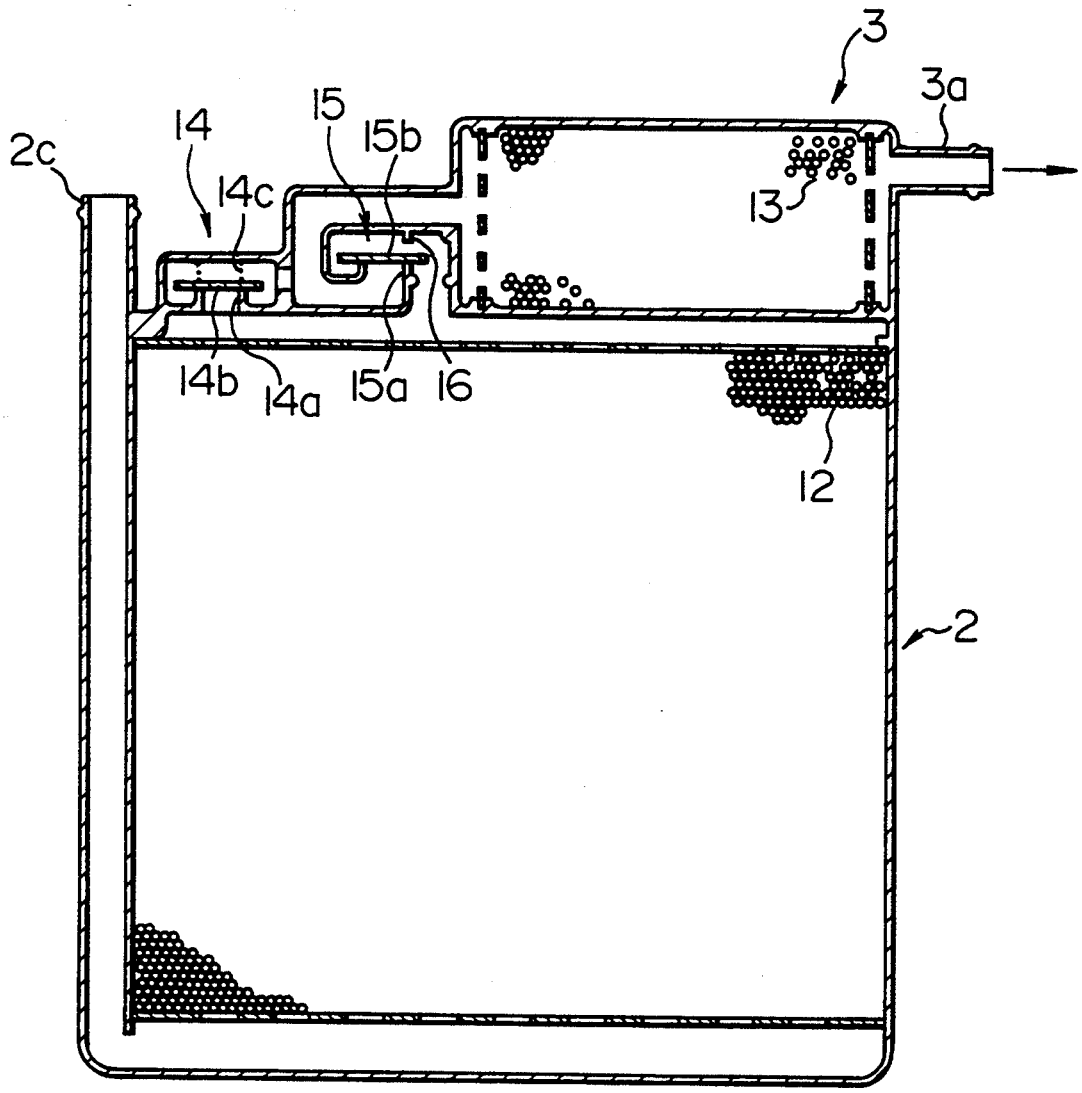
FIG. 1 is a vertical cross-sectional view of a first embodiment according to the present invention.

FIG. 1 shows a first embodiment according to the present invention, corresponding to the above-mentioned first aspect of the invention.

A main canister 2 and a sub-canister 3 are formed of an integral casing and filled with absorbents 12 and 13, respectively. A port 2*c* of the main canister 2 is communicated with a fuel tank and a suction air pipe through a vapor passage 4 and a purge passage 5, as shown in FIG. 8.

The sub-canister 3 has an air port 3*a*. First and second one-way valves 14 and 15 are provided between the main canister 2 and the sub-canister 3 and located in parallel to each other.

The first one-way valve 14 comprises a valve seat 14*a*, a valve body 14*b*, and a spring 14*c* for elastically pressing the valve body 14*b* on the valve seat 14*a*. The second one-way valve 15 comprises a valve seat 15*a* and a plate-like valve body 15*b* which is closely attached on the valve seat 15*a* by its own weight.

A projection 16 restricts upward movement of the valve body 15*b*.

Weights of the valve bodies 14*b* and 15*b*, a load of the spring 14*c* and so forth are determined in such a manner that the first one-way valve 14 allows a flow from the main canister 2 toward the sub-canister 3 when it receives a predetermined valve opening pressure or more, and that the second one-way valve 15 allows a flow from the sub-canister 3 toward the main canister 2 when it receives a predetermined valve opening pressure or more, this predetermined valve opening pressure being smaller than that of the first one-way valve 14.

Figure 2:
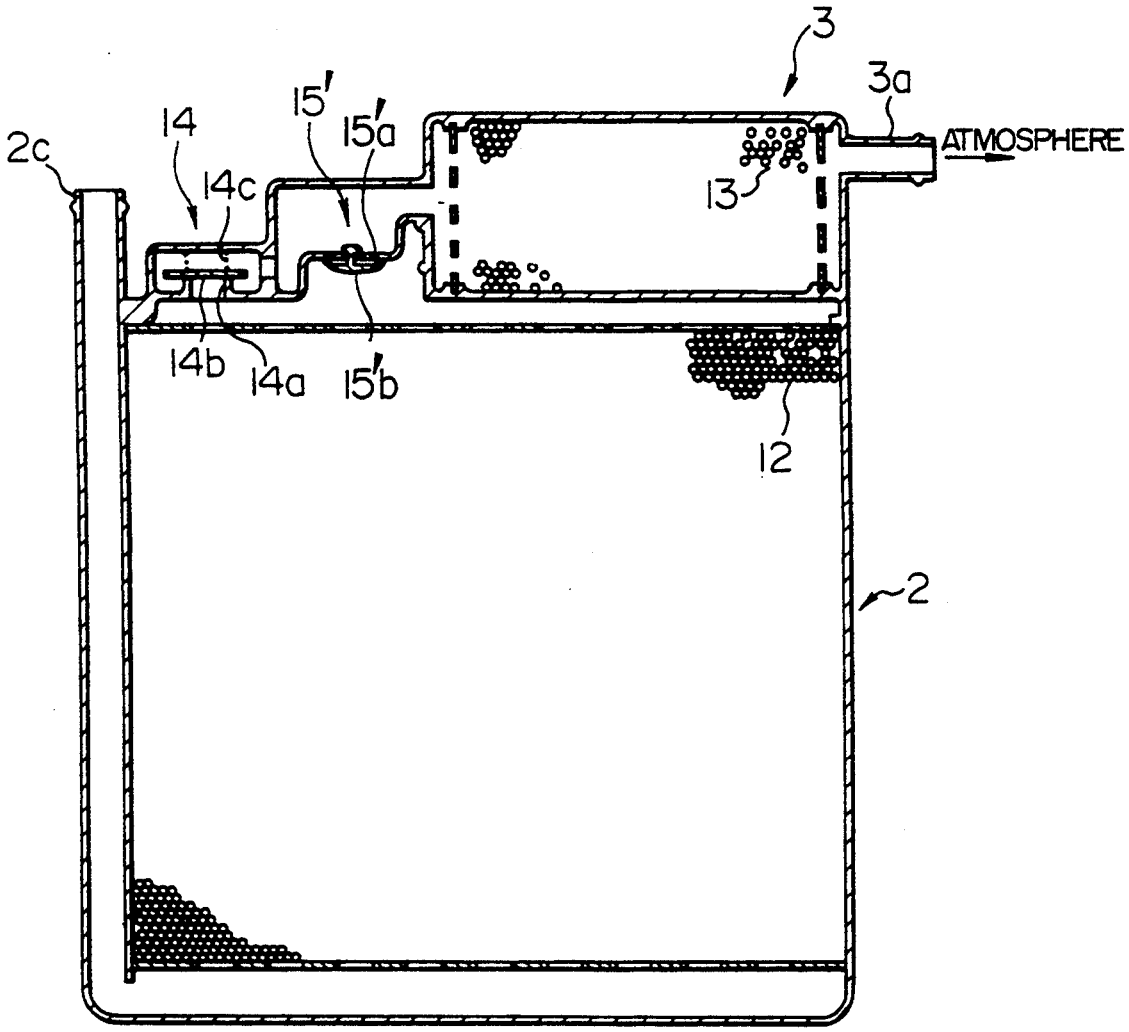
FIG. 2 is a vertical cross-sectional view of a second embodiment according to the invention.

FIG. 2 shows a second embodiment according to the present invention, corresponding to the first aspect of the invention, in which a valve body 15'*b* of the second one-way valve 15' is made of an elastic material and has a mushroom-like shape.

This embodiment is different from the first embodiment shown in FIG. 1 only in the structure of the second one-way valve 15'. More specifically, in this embodiment, the second one-way valve 15' comprises a valve seat 15'*a* and the valve body 15'*b* made of an elastic material having a mushroom-like shape which is elastically fitted on the valve seat 15'*a*.

Such a structure of the second one-way valve 15' is simple and excellent in vibration proof. It is suitable for this kind of one-way valve.

Figure 3A:
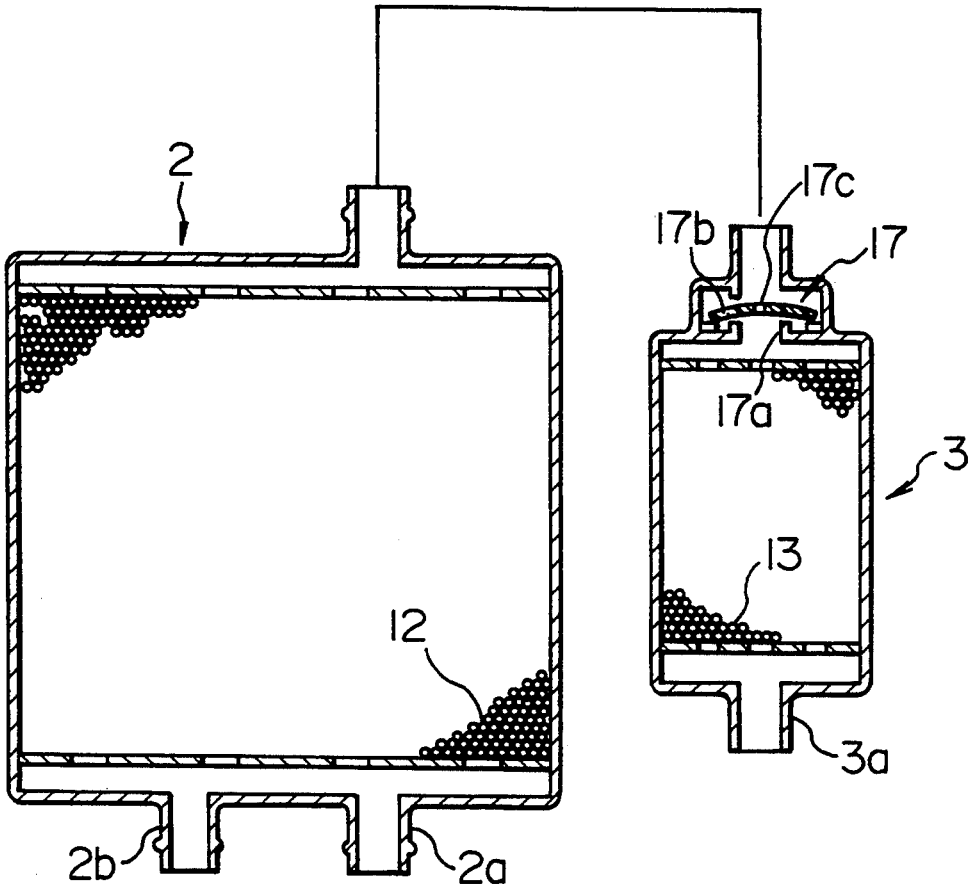
FIGS. 3A and 3B are vertical cross-sectional views of a third embodiment according to the invention.
Figure 3B:
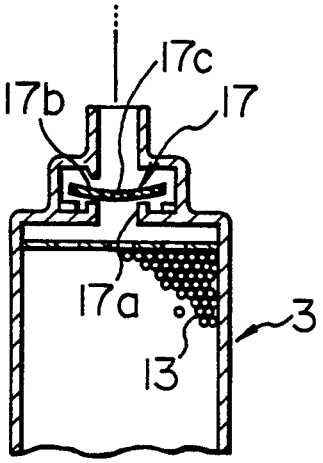

FIGS. 3A and 3B show a third embodiment according to the invention, corresponding to the second aspect of the invention, in which a main canister 2 and a sub-canister 3 are formed as individual members, and a thermally responsive valve 17 is provided on a passage communicating these two members at a side of the sub-canister. An opening area of the thermally responsive valve 17 is large at a high temperature and small at a low temperature.

The thermally responsive valve 17 includes a valve body 17*b* made of bimetal having a spherical round thin plate-like shape which is provided on a valve seat 17*a*. Further, a small hole 17*c* is formed in the center of the valve body 17*b*, penetrating from the upper surface to the lower surface of the valve body.

At a low temperature, the valve body 17*b* is curved to project downwardly, as shown in FIG. 3B, and the downwardly projecting spherical surface thereof is fitted on the valve seat 17*a*, so that a flow from the main canister 2 toward the sub-canister 3 is limited only to a passage area of the small hole 17*c*.

The counter flow is determined by an area of the small hole 17*c* and a weight of the valve body 17*b*.

When the temperature rises, the valve body 17*b* made of bimetal is curved to project reversely, as shown in FIG. 3A, and it is detached from the valve seat 17*a*. Consequently, the passage area of the one-way valve 17 is increased, to thereby carry out the purge adequately.

Moreover, in the third embodiment, as described before, when the temperature is low immediately after starting of the engine, the one-way valve 17 is in the condition shown in FIG. 3B so that the purge flow rate is restricted by the small hole 17*c* and the weight of the valve body 17*b*. Therefore, supply of dense fuel vapor from the purge passage to the engine is suppressed.

As a result, unfavorable influences on an air-fuel ratio can be prevented.

Figure 4:
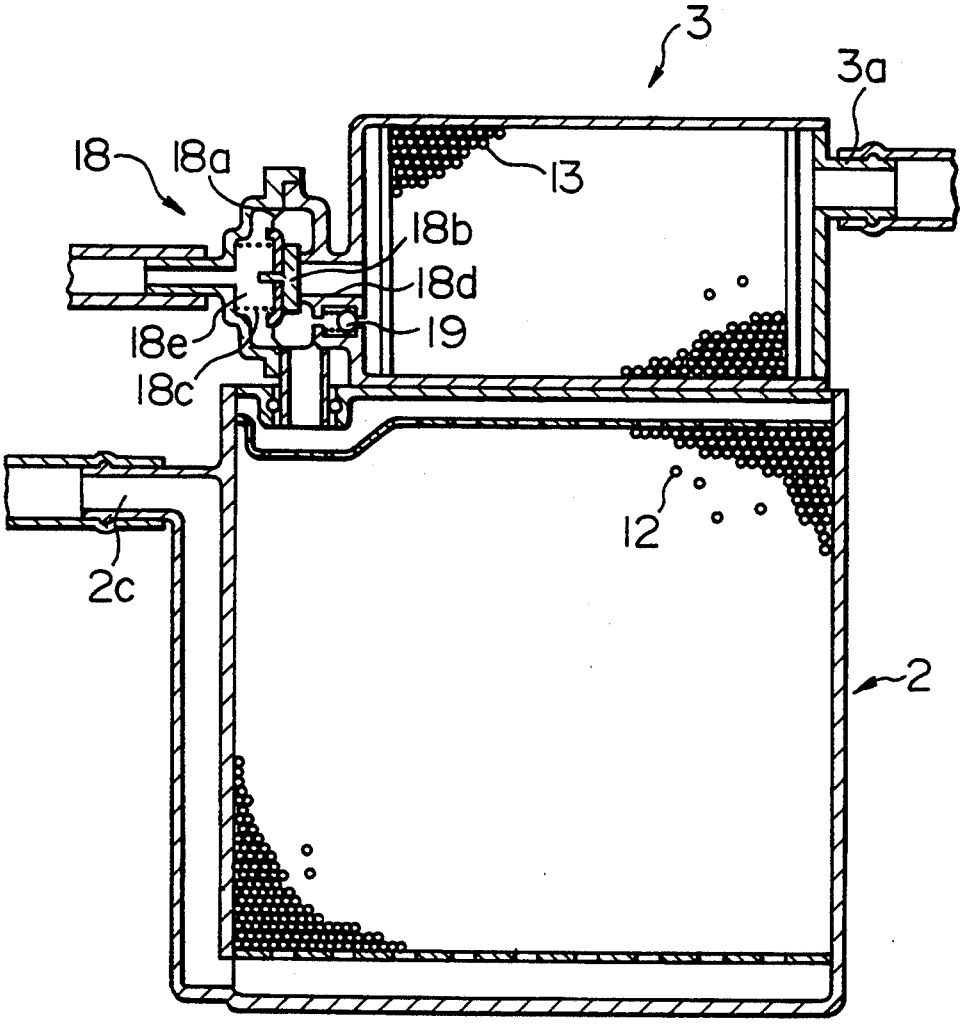
FIG. 4 is a vertical cross-sectional view of a fourth embodiment according to the invention.

FIG. 4 shows a fourth embodiment according to the present invention, corresponding to the third aspect of the invention, in which an open and close valve 18 of a diaphragm type is provided between a main canister 2 and a sub-canister 3. An opening area of the open and close valve 18 varies in accordance with a suction-pipe negative pressure to the atmospheric pressure.

The open and close valve 18 comprises a valve body 18*b* attached to the center of a diaphragm 18*a*, and a spring 18*c* which urges the valve body 18*b* toward a valve seat 18*d*. When a suction-pipe negative pressure to the atmospheric pressure is applied to a diaphragm chamber 18*e*, the diaphragm 18*a* is moved to the left of the drawing against the force of the spring 18*c* to a degree in accordance with the negative pressure to the atmospheric pressure, thus increasing the opening area of the open and close valve 18.

A check valve 19 is provided in parallel to the open and close valve 18. When the temperature falls and the tank internal pressure is lowered, the check valve 19 is opened, to thereby prevent breakage of the fuel tank.

In this embodiment, the open and close valve 18 is opened depending on the suction-pipe negative pressure to the atmospheric pressure, and consequently, it does not create any resistance with respect to the purge flow rate. Therefore, the purge performance is particularly favorable.

Figure 5:
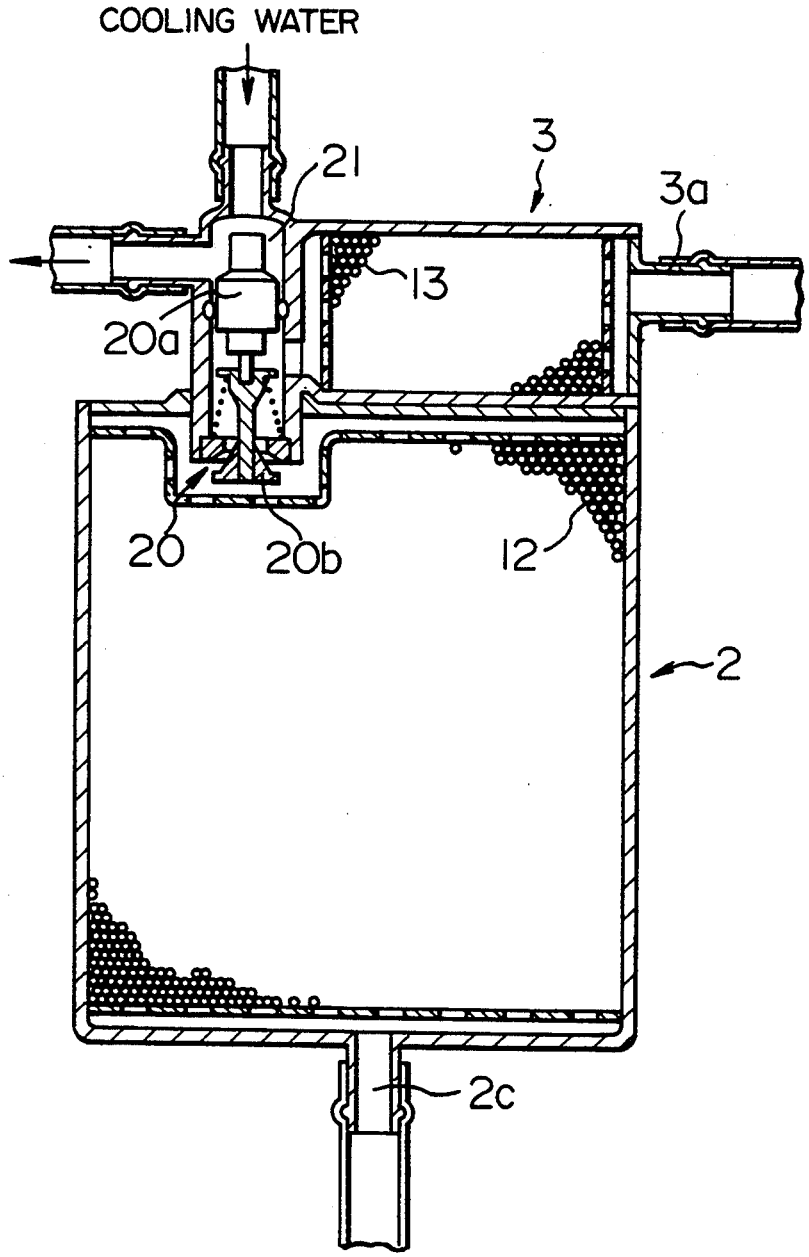
FIG. 5 is a vertical cross-sectional view of a fifth embodiment according to the invention.

FIG. 5 shows a fifth embodiment according to the present invention, corresponding to the fourth aspect of the invention, in which a cooling water responsive valve 20 is provided between a main canister 2 and a sub-canister 3. An opening area of the cooling water responsive valve 20 varies in accordance with a temperature of cooling water of the engine.

The cooling water responsive valve 20 includes a valve body 20*b* which moves when a rod of a thermostat 20*a* provided in a cooling water passage 21 advances and retreats, and is designed in such a manner that as the temperature of cooling water rises, the opening area of the responsive valve 20 becomes larger.

Therefore, when the temperature of cooling water is low, the opening area of the responsive valve 20 is small, to thereby suppress release of fuel vapor into the atmosphere, and to reduce a variation in the air-fuel ratio at the time of starting of the engine.

When the temperature of the cooling water rises, the opening area of the responsive valve 20 is enlarged, thus increasing the purge flow rate.

Figure 6:
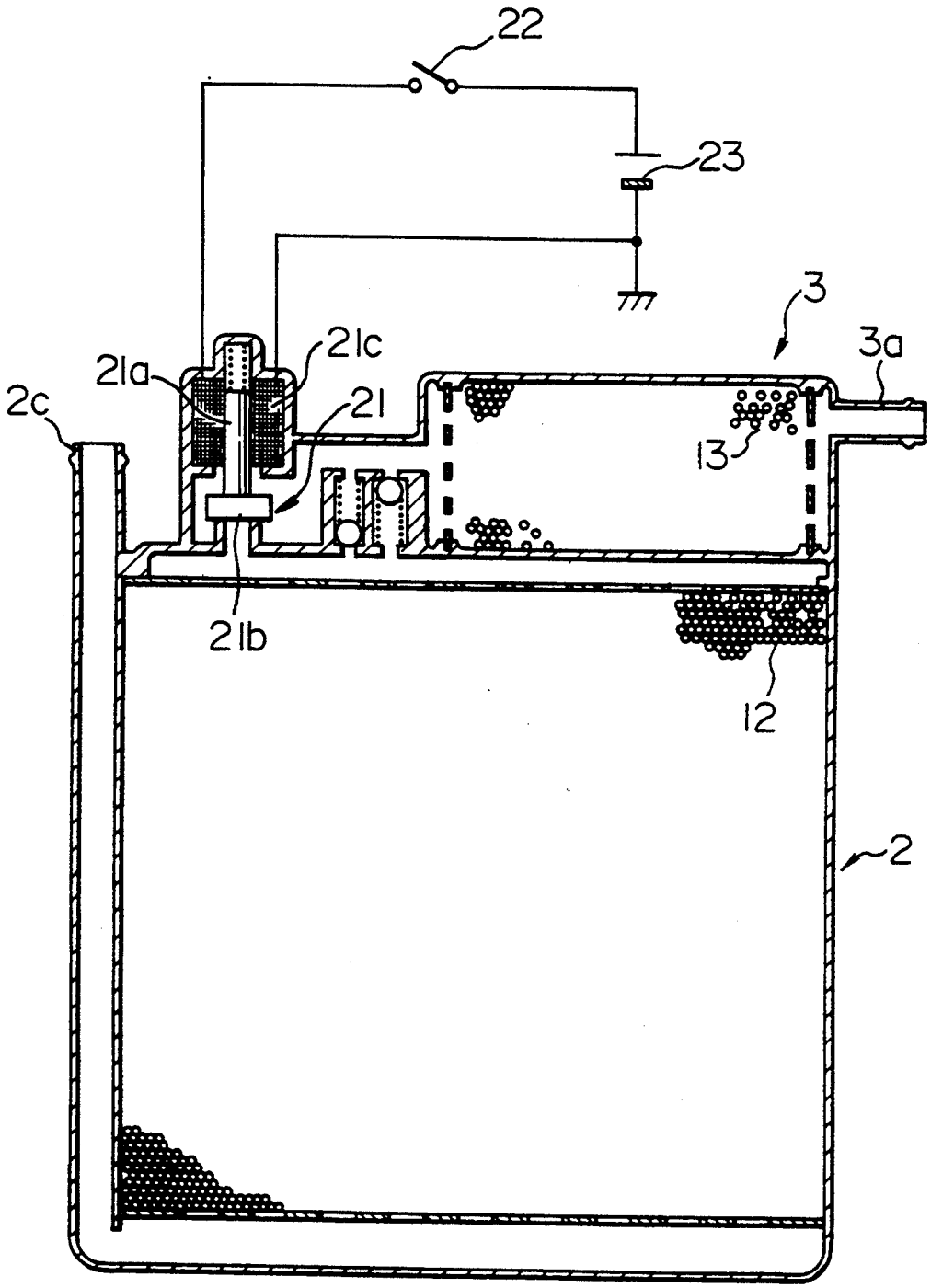
FIG. 6 is a vertical cross-sectional view of a sixth embodiment according to the invention.

FIG. 6 shows a sixth embodiment according to the present invention, corresponding to the fifth aspect of the invention, in which a solenoid valve 21 is inserted between a main canister 2 and a sub-canister 3, and a coil 21*c* of the solenoid valve 21 and a battery 23 are connected through an ignition key switch 22 of the vehicle.

When the key switch 22 is turned on, i.e., during driving of the vehicle, power is supplied from the battery 23 to the coil 21*c*, and a plunger 21*a* moves the valve body 21*b* upwardly so as to open the solenoid valve 21, thereby facilitating the purge.

When the engine is stopped, the valve body 21*b* is closed to prevent fuel vapor from being released into the atmosphere via an air port 3*a* of the sub-canister 3.

Since the fuel vapor processing apparatus according to the present invention has the above-described structure, release of fuel vapor into the atmosphere through the sub-canister is reduced, and also, the purge flow rate is increased. Thus, the problems of the conventional technique can be solved.

What is claimed is:

1. A fuel vapor processing apparatus of an internal combustion engine for a vehicle, comprising a main canister, a sub-canister connected to the main canister in series and disposed between the atmosphere and the main canister, a first one-way valve through which the fluid flows from said main canister to said sub-canister, and a second one-way valve through which the fluid flows from said sub-canister to said main canister, said first and second one-way valves being provided in parallel between said main canister and said sub-canister.

2. A fuel vapor processing apparatus according to claim 1, wherein a valve opening pressure of said first one-way valve is set higher than that of said second one-way valve.

3. A fuel vapor processing apparatus according to claim 2, wherein said first one-way valve includes a spring which presses a valve body on a valve seat, and said second one-way valve includes a valve body which is closely fitted on a valve seat by its own weight.

4. A fuel vapor processing apparatus according to claim 1, wherein said first one-way valve includes a spring which presses a valve body on a valve seat, and said second one-way valve includes a valve body of a mushroom-like shape which is made of an elastic material.

5. A fuel vapor processing apparatus of an internal combustion engine for a vehicle, comprising a main canister, a sub-canister connected to the main canister in series and disposed between the atmosphere and the main canister, and a thermally responsive valve whose opening area varies in accordance with the temperature, said thermally responsive valve being provided between said main canister and said sub-canister and constructed in such a manner that the opening area of said thermally responsive valve is large at a high temperature and small at a low temperature.

6. A fuel vapor processing apparatus according to claim 5, wherein said thermally responsive valve comprises a valve seat and a spherical valve body made of bimetal which is provided on the valve seat, said valve body including a small hole formed in the center and being designed to be curved to project reversely in accordance with the temperature so that the valve body is curved to be closely fitted on said valve seat when the temperature is low.

7. A fuel vapor processing apparatus of an internal combustion engine for a vehicle, comprising a main canister, a sub-canister connected to the main canister in series and disposed between the atmosphere and the main canister, and an open and close valve which is opened by a suction-pipe negative pressure of the engine, said open and close valve being provided between said main canister and said sub-canister.

8. A fuel vapor processing apparatus of an internal combustion engine for a vehicle, comprising a main canister, a sub-canister connected to the main canister in series and disposed between the atmosphere and the main canister, and a cooling water responsive valve which is operated in accordance with the temperature of cooling water of the engine, said cooling water responsive valve being provided between said main canister and said sub-canister and designed in such a manner that an opening area of said cooling water responsive valve is larger as the temperature of said cooling water rises.

9. A fuel vapor processing apparatus of an internal combustion engine for a vehicle, comprising a main canister, a sub-canister connected to the main canister in series and disposed between the atmosphere and the main canister, and a solenoid valve which is provided between said main canister and said sub-canister and connected in such a manner that the solenoid valve is opened when an ignition key switch of the vehicle is turned on.

* * * * *